United States Patent [19]

Norman

[11] Patent Number: 4,741,475

[45] Date of Patent: May 3, 1988

[54] MASS MAILER

[75] Inventor: John A. Norman, Downers Grove, Ill.

[73] Assignee: Uarco Incorporated, Barrington, Ill.

[21] Appl. No.: 11,293

[22] Filed: Feb. 5, 1987

[51] Int. Cl.[4] ..... B65D 27/04

[52] U.S. Cl. ..... 229/71; 229/69; 283/73

[58] Field of Search ..... 229/68 R, 69, 71, 73; 283/65, 17, 73; 256/459

[56] References Cited

U.S. PATENT DOCUMENTS

| | | | |
|---|---|---|---|
| 3,104,799 | 9/1963 | Steidinger . | |
| 3,380,648 | 4/1968 | De Lyra | 229/71 |
| 3,442,438 | 5/1967 | Marban | 229/68 R |
| 3,554,438 | 1/1971 | Van Malderghem | 206/632 |
| 4,385,693 | 5/1983 | Gelardi et al. | 206/459 |
| 4,403,696 | 9/1983 | Newell | 229/73 |
| 4,413,730 | 11/1983 | Morse | 206/459 |
| 4,431,214 | 2/1984 | Buffington | 283/65 |
| 4,580,814 | 4/1986 | Berler | 283/65 |

*Primary Examiner*—Stephen P. Garbe

*Attorney, Agent, or Firm*—Wood, Dalton, Phillips, Mason & Rowe

[57] ABSTRACT

A mailing piece for use in mass mailings including an envelope having insert material 26 within the envelope. An index mark 76 on the insert 26 are correlated with index openings 64, 66, 68 on the front 22 of the envelope so that, for example, the answers to questions disposed in areas 58, 60, 62 on the insert may be displayed to the recipient of the mailer through a window 56 in the front 22 of the envelope upon alignment of the index mark 76 with the index openings 64, 66 and 68 with such answers corresponding to questions located in areas 70, 72 and 74 associated with each index opening 64, 66 and 68.

10 Claims, 1 Drawing Sheet

MASS MAILER

FIELD OF THE INVENTION

This invention relates to business forms, and more particularly, to business forms that are adapted for use in mass mailing.

BACKGROUND OF THE INVENTION

Issuing so-called "mass mailings" is a common and accepted method of both merchandising and soliciting. Commonly, only a small fraction of the recipients of a mass mailing respond to the mass mailing. Evidently, one significant factor in the low response rate resides in the recognition by the recipient that a particular mailing piece is part of a mass mailing whereupon it is disposed of without being opened or otherwise considered. Nonetheless, even with low response rates, mass mailings are commercially viable.

At the same time, it has been recognized that even small increases in the rate of response to a mass mailing would considerably improve the economics of mass mailings as a merchandising or solicitation tool. Consequently, a number of efforts have been made to make the pieces of a mass mailing such that the recipient of the mailing piece would be more apt to open, and presumably consider the subject matter of, the mailing piece.

One common method used to obtain this goal is making the mailing pieces of a mass mailing appear to be individualized mailings, and not part of a mass mailing. This method is based on the perception that a recipient is much more inclined to open and consider a mailing piece that is addressed to the intended recipient personally and which appears to be sent to the intended recipient individually, than a mailing piece without either one or both of these attributes.

Another common technique is to provide the mailing piece with some sort of information on its exterior, which therefore is readily viewable by the recipient without opening the mailing piece and which appeals to some sense of the recipient. For example, a sweepstakes offer may be utilized to appeal to the recipient's desire for financial well being. Alternatively, a rhetorical question that appeals to the recipienty's sense of curiosity may be utilized.

Quite obviously, not all potential recipients for mass mailings respond to the same stimulus and as a consequence, it is desired to provide means in addition to those specified above for encouraging a recipient of a mass mailing piece to open the same and consider the subject matter thereof. The present invention is directed to accomplishing that goal.

SUMMARY OF THE INVENTION

It is the principal object of the invention to provide a new and improved mass mailing piece. More specifically, it is an object of the invention to provide an improved mass mailing piece provided with means that, when viewed by a recipient, will encourage the recipient to open the mailing piece and consider the subject matter thereof.

According to the invention, there is provided a mailer which includes an envelope including a front, a back and an end adapted to be opened to achieve access to the contents of the envelope and remove the same therefrom in a direction of withdrawal. Insert material is located within the envelope and is removable therefrom in the direction of withdrawal through the end when the end is open. A viewing area is located on the front or the back of the envelope at which an aligned portion of the insert material may be viewed. A series of at least two index marks are disposed on the front or back, each spaced from each other along a line generally parallel to the direction of withdrawal and a series of first data receiving areas is also disposed on the front or back, one area for each of the index marks and correlated with the associated index mark.

Another index mark is located on the insert material and generally on the aforementioned line so as to be selectively alignable with each of the index marks in the series as the insert material is removed from the envelope end in the direction of withdrawal. A series of second data receiving areas is disposed on the insert material, with the areas spaced from each other along a line generally parallel to the direction of withdrawal and alignable with the viewing area. Each of the second data receiving areas corresponds to one of the index marks in the series with adjacent ones of the second data receiving areas being spaced a distance corresponding to the spacing between the corresponding index marks in the series. Thus, when the index mark on the insert is aligned with any one of the index marks in the series, the corresponding second data receiving area will be disposed at the viewing area. Consequently, data in the first data receiving area can be mentally correlated with data in the corresponding second data receiving area which then appears at the viewing area.

Thus, questions which may be of an educational or even a rhetorical nature can be located in the first data receiving areas and respective answers located at the corresponding second data receiving areas. A recipient of the mailer, viewing the questions posed in the first data receiving areas on the front of the envelope will have his sense of curiosity or intellect appealed to and will open the envelope to determine the answers to the various questions. Thus, the mailer succeeds in causing the recipient to open the mailing piece such that the subject matter thereof can be considered.

In a highly preferred embodiment, the viewing area is at least in part defined by an edge of the front of the envelope, and preferably, the edge is an interior edge such as defined by a window. The window may or may not be designed to additionally display recipient address information for one position of the insert within the envelope.

A highly preferred embodiment of the invention also contemplates that the index marks in the series be small openings in the envelope.

In some instances, the questions and/or answers and messages may be printed prior to or during the assembly of the mailing piece while in others, such material may be printed after assembly of the envelope. In any case, the printed material may possibly even be tailored to the particular recipient. In the case of the post assembly printing, image transfer material may be located at the interface of the front and the insert about at least some of the data receiving areas so that variable information may be printed within the second data receiving areas as well as elsewhere on the insert material.

Other objects and advantages will become apparent from the following specification taken in connection with the accompanying drawings.

DESCRIPTION OF THE PREFERRED EMBODIMENT

Figure 1:
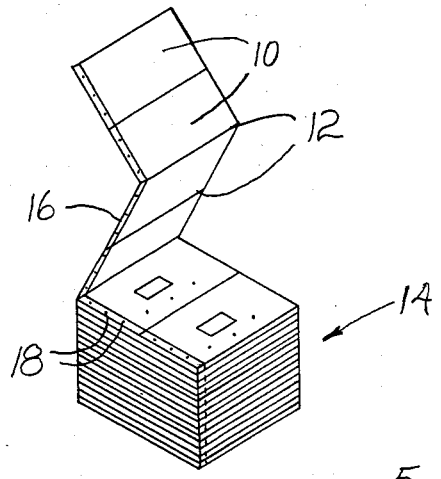
FIG. 1 is a perspective view of a continuous business form embodying the invention.

An exemplary embodiment of a business form made according to the invention as a continuous business form is illustrated in the drawings and with reference to FIG. 1 is seen to include a series of individual form lengths 10 interconnected at transverse lines of weakening 12 and folded on alternate ones of the transverse lines of weakening 12 into a zigzag folded stack, generally designated 14. Along at least one longitudinal margin of the assembly is a so-called control punch margin 16 having a plurality of pin feed holes 18 whereby the form may be manufactured and subsequently processed in a well known fashion.

Conventionally, after the assembly has been processed as by addressing each individual form length 10 and providing such other additional variable information on each form length 10 as may be desired, the individual form lengths 10 will be separated at the transverse lines of weakening 12 and deposited in the mail. However, in some instances, particularly where printing occurs prior to (as by ink jet printing) or during collation of the various plies (as by so-called "add mark" printing) into the assembly, the same will be separated into individual form lengths immediately upon fabrication. In some cases, but not always, the control punch margin 16 may be separated from the remainder of the assembly along a longitudinal line of weakening 20. Conventionally, the lines of weakening 12 and 20 will be formed by perforations. Furthermore, in some instances the envelopes may be in non-continuous form as individual envelopes.

The form of the invention illustrated in the drawings is a left side opening envelope although those skilled in the art will readily appreciate that the invention is applicable to right side, top side or bottom side opening envelopes as well.

As seen in FIGS. 2–5 inclusive, each individual form length 10 includes an envelope defined by a front 22, a back 24 and insert material 26 between the front 22 and the back 24. Conventionally, the front 22, the back 24, and the insert material 26 will be formed of elongated plies of paper as is well known. Needless to say, the width of the various plies as well as the vertical dimension of each individual form length 10 can be varied as desired.

Figure 3:
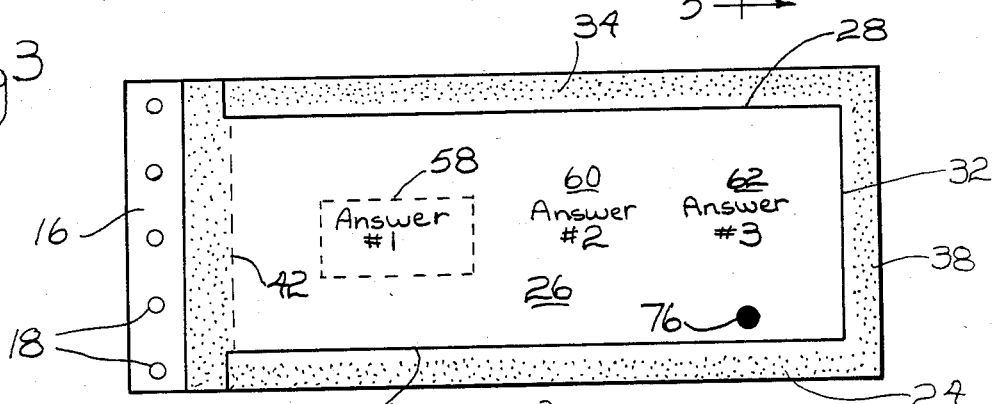
FIG. 3 is a view similar to FIG. 2 showing an individual form length of the business form but with the front of the same removed.
Figure 4:
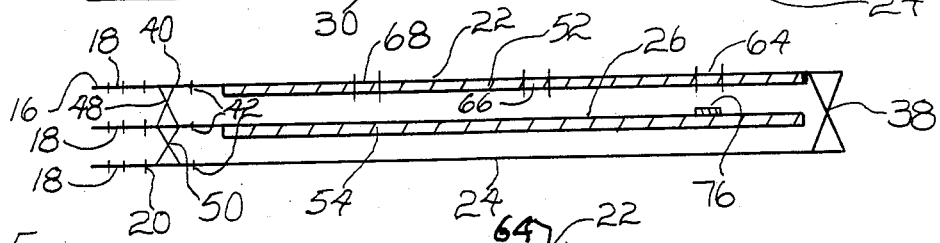
FIG. 4 is a somewhat schematic, sectional view taken approximately along the line 4—4 in FIG. 2.
Figure 5:
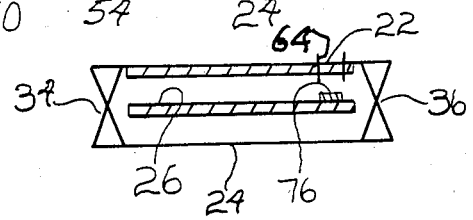
FIG. 5 is a somewhat schematic sectional view taken approximately along the line 5—5 in FIG. 2.

As best seen in FIGS. 3–5, the insert material 26 may be die cut at a top edge 28, a bottom edge 30, and one side edge 32 in the manner disclosed in Steidinger U.S. Pat. No. 3,104,799. The die cuts at these edges provide areas whereby a top glue line 34, a bottom glue line 36, and a side glue line 38 may adhere the front 22 and back 24 together to form a U-shaped pocket extending around and receiving the insert 26. Thus, the insert 26 is not captured by the glue lines 34, 36, 38.

The end of the envelope opposite the glue line 38 and the end 32 of the insert is provided with a tear strip 40 which is separated from the remainder of the envelope by a line of weakening 42 such as a perforation which is located in each of the plies defining the front 22, back 24 and insert 26. If desired, a thumb notch 44 can be located in the front 22 and back 24 of the envelope. Thus, by removing the tear strip 40 from the envelope, the insert 26, which was freed from attachment to the envelope by removal of the tear strip 40, may be grasped and removed from the left hand end of the envelope as viewed in the drawing in a direction that is generally parallel to the transverse of weakening 12, that is, a direction that is transverse to the end bearing the tear strip 40.

For registration purposes, and to close the envelope, glue lines 48 and 50 (FIG. 4) extend respectively between the front 22 and the insert 26, and the insert 26 and the back 24 at the tear strip 40.

Where the mailer is intended to be printed upon after it has been assembled, it will include interior image transfer material such as that schematically illustrated at 52 at the interface of the front 22 and the insert 26 whereby impressions made on the front 22 will appear on the insert 26. If desired, similar image transfer material 54 may be located at the interface of the insert 26 and the back 24 so as to provide for printing on the back 24. It will also be appreciated that one or more plies of insert material in addition to that shown at 26 may be utilized within the envelope with the provision of image transfer material at the various interfaces.

Conversely, where the printing is applied prior to assembly of the mailer as by ink jet printing or during assembly as by so-called "add mark" printing, the image transfer material 52, 54 may be omitted.

Figure 2:
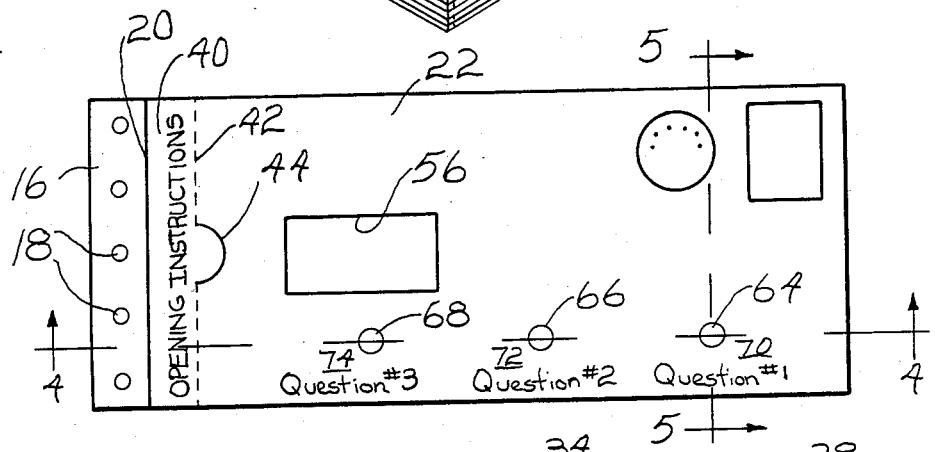
FIG. 2 is a plan view of an individual form length of the business form.

According to the invention, the front 22 or the back 24 of the envelope is provided with a viewing area. In the preferred embodiment of the invention, the viewing area is defined at least in part by an interior edge 56 on the front 22 and as illustrated in FIG. 2, the edge 56 is rectangular or any other desired shape such as a circle and in fact defines a window in the front of the envelope. The envelope, in some cases, may be addressed by printing the name and address of the intended recipient on the insert 26 through the window 56 in an area 58 on the insert 26. However, the window 56 may be wholly separate from any recipient address receiving area if desired. For purposes to be seen, the insert 26 includes additional areas 60 and 62 that are aligned with the area 58 and spaced therefrom, and from each other, along the direction of removal of the insert 26 from the envelope. Each data receiving area 58, 60 and 62 is adapted to receive printed information. The printed information may either be so-called "static" information or so-called "variable" information. Static information is that which would remain the same from one recipient to the next throughout the entire mailing. That is to say, it would not be individualized or personalized. Conversely, variable information is that which would vary from one mailer to the next throughout the mailing and would be customized or tailored to a particular individual or some group of individuals within the total number of individuals receiving the mailing.

The front 22 or the back 24 of the envelope is further provided with a series of index marks. In the illustrated embodiment these are in the form of small openings 64, 66 and 68 in the front 22. The openings 64, 66 and 68 are aligned with each other and spaced along a line that is parallel to the direction of withdrawal of the insert 26 from the envelope.

Immediately adjacent each of the index openings 64, 66 and 68 is an associated data receiving area 70, 72 and 74, one for each of the openings 64, 66 and 68 respectively. Like the areas 58, 60 and 62 on the insert, the data receiving areas 70, 72 and 74 are adapted to receive static or variable information as desired for purposes to be seen.

Another index mark is shown at 76 and is located on the insert 26 on the line defined by the openings 64, 66 and 68. The index mark 76 may simply be a printed spot of a color that contrasts with the color of the remainder of the insert 26 and/or the front 22 so as to be readily apparent when aligned with one of the openings 64, 66 and 68.

In addition, the index mark 76 is so disposed on the insert 26 so that when visible (a) through the opening 64, the data receiving area 58 will be viewable through the window 56; (b) through the index opening 66, the data receiving area 60 will be viewable through the window 56; and (c) through the index opening 68, the data receiving area 62 will be viewable through the window 56.

Thus, alignment of the index mark 76 with an index opening 64, 66 and 68 serves as a means of allowing a mental correlation of (a) data in the data receiving area 70 with that displayed through the window 56 and in the data receiving area 58 when the index elements 76 and 64 are aligned; (b) data in the data receiving area 72 with that in the data receiving area 60 when the index elements 76 and 66 are aligned; and (c) data in the area 74 correlated with data in the area 62 when the elements 76 and 68 are aligned.

In one method of use of the structure, and as illustrated in FIGS. 2 and 3, various questions can be disposed in the data receiving area 70, 72 and 74 located on the front 22 of the envelope and then the answers to the questions respectively disposed in the areas 58, 60 and 62 on the insert 26. Where the address of the recipient is printed on the insert through the window 56, the question disposed in the area 70 may be something to the effect of "To Whom is this Envelope Addressed?". Alternatively, the envelope may be addressed on the front 22 at a location other than the window 56 and some other question and answer utilized.

It should also be recognized that while the preferred embodiment shows the index mark 76 essentially prealigned with the index opening 64 before the envelope 22 is opened, this is not at all necessary.

In some instances, the mailer of the invention may be a return mailer located within a somewhat larger envelope and sent to the original recipient in that manner. The recipient will open the original mailer to expose the return mailer and may remove preprinted insert material from the return mailer in the manner mentioned previously.

On occasion, both questions and answers might be located on the insert material with, for example, the questions viewable through a window and the answers viewable at an open edge of the envelope. Indexing of the insert could be accomplished in such a situation through the use of several dots on the insert material alignable with a single hole in the front 22 or back 24 of the envelope.

To facilitate whatever preferred method of use of the product is desired, opening and use instructions may be disposed on the tear strip 40 as generally indicated in FIG. 2 as desired. A recipient, upon reading such instructions, will have his sense of intellect or curiosity appealed to and will open the mailing to obtain answers to the question, where the just described method of use is being employed. As a consequence of his opening the mailing for this purpose, he will expose the subject matter of the mailing. And the person or party instigating the mass mailing will have gotten past the first hurdle in achieving an increased response to the mailing, namely, disposition of a mass mailing piece by the recipient without even opening it.

Thus, a mass mailer according to the invention will increase the response to a mass mailing and is ideally suited for use with variable information that will appeal to each individual recipient of the mailing.

I claim:

1. A mailer comprising:

an envelope including a front, a back and an end adapted to be opened to achieve access to the contents of the envelope and remove the same therefrom in a direction of withdrawal;

insert material within the envelope and removable therefrom through said end in said direction of withdrawal when said end is opened;

a window in said front through which an aligned portion of said insert material may be viewed;

a series of at least two index openings in said front, each spaced from each other along a line generally parallel to said direction of withdrawal;

a series of first data receiving areas on said front, one for each of said index openings, and located adjacent the associated index opening;

an index mark on said insert material, and located generally on said line so as to be selectively alignable with each of said index openings as said insert material is removed from said end in said direction of withdrawal; and a series of second data receiving areas on said insert material and spaced from each other along a line generally parallel to said direction of withdrawal and alignable with said window, each said second data receiving area corresponding to one of said index openings with adjacent ones of said second data receiving areas being spaced a distance corresponding to the spacing between the corresponding index openings such that when said index mark is aligned with any one of said index openings, the corresponding second data receiving area will be viewable through said window;

whereby data in a first data receiving area indexed by said index mark through the corresponding index opening can be mentally correlated with data in the corresponding second data receiving area appearing through said window.

2. The mailer of claim 1 wherein image transfer material is located at the interface of said front and said insert material about at least some of said second data receiving areas so that variable information may be printed in said some second data receiving areas after the insert material is located in said envelope.

3. The mailer of claim 1 wherein said end includes a tear strip.

4. A mailer comprising:

an envelope including a front, a back and an end adapted to be opened to achieve access to the contents of the envelope and remove the same therefrom in a direction of withdrawal;

insert material within the envelope and removable therefrom through said end in said direction of withdrawal when said end is opened;

a window in said front through which an aligned portion of said insert material may be viewed;

a series of at least two index openings in said envelope, each spaced from each other along a line generally parallel to said direction of withdrawal;

a series of first data receiving areas on said envelope, one for each of said index openings, and located adjacent the associated index opening;

an index mark on said insert material, and located generally on said line so as to be selectively alignable with each of said index openings as said insert material is removed from said end in said direction of withdrawal; and a series of second data receiving areas on said insert material and spaced from each other along a line generally parallel to said direction of withdrawal and alignable with said window, each said second data receiving area corresponding to one of said index openings with adjacent ones of said second data receiving areas being spaced a distance corresponding to the spacing between the corresponding index openings such that when said index mark is aligned with any one of said index openings, the corresponding second data receiving area will be viewable through said window;

whereby data in a first data receiving area indexed by said index mark through the corresponding index opening can be mentally correlated with data in the corresponding second data receiving area appearing through said window.

5. A mailer comprising:

an envelope including a front, a back and an end adapted to be opened to achieve access to the contents of the envelope and remove the same therefrom in a direction of withdrawal;

insert material within the envelope and removable therefrom through said end in said direction of withdrawal when said end is opened;

a window in said front through which an aligned portion of said insert material may be viewed;

a series of at least two index marks on said front, each spaced from each other along a line generally parallel to said direction of withdrawal;

a series of first data receiving areas on said front, one for each of said index mark, and correlated with the associated index mark;

an index mark on said insert material, and located generally on said line so as to be selectively alignable with each of said index marks in said series as said insert material is removed from said end in said direction of withdrawal; and a series of second data receiving areas on said insert material and spaced from each other along a line generally parallel to said direction of withdrawal and alignable with said window, each said second data receiving area corresponding to one of said index marks in said series with adjacent ones of said second data receiving areas being spaced a distance corresponding to the spacing between the corresponding index marks in said series such that when said index mark on said insert is aligned with any one of said index marks in said series, the corresponding second data receiving area will be viewable through said window;

whereby data in a first data receiving area indexed by said index mark on said insert at the corresponding index mark in said series can be mentally correlated with data in the corresponding second data receiving area appearing through said window.

6. A mailer comprising:

an envelope including a front, a back and an end adapted to be opened to achieve access to the contents of the envelope and remove the same therefrom in a direction of withdrawal;

insert material within the envelope and removable therefrom through said end in said direction of withdrawal when said end is opened;

a viewing area on said front at which an aligned portion of said insert material may be viewed;

a series of at least two index marks on said front, each spaced from each other along a line generally parallel to said direction of withdrawal;

a series of first data receiving areas on said front, one for each of said index mark, and correlated with the associated index mark;

an index mark on said insert material, and located generally on said line so as to be selectively alignable with each of said index marks in said series as said insert material is removed from said end in said direction of withdrawal; and a series of second data receiving areas on said insert material and spaced from each other along a line generally parallel to said direction of withdrawal and alignable with said viewing area, each said second data receiving area corresponding to one of said index marks in said series with adjacent ones of said second data receiving areas being spaced a distance corresponding to the spacing between the corresponding index marks in said series such that when said index mark on said insert is aligned with any one of said index marks in said series, the corresponding second data receiving area will be disposed at said viewing area;

whereby data in a first data receiving area indexed by said index mark on said insert at the corresponding index mark in said series can be mentally correlated with data in the corresponding second data receiving area appearing at said viewing area.

7. The mailer of claim 6 wherein said viewing area is at least in part defined by an edge of said front.

8. The mailer of claim 7 wherein said edge is an interior edge.

9. The mailer of claim 8 wherein said interior edge defines a window in said front.

10. A mailer comprising:

an envelope including a front, a back and an end adapted to be opened to achieve access to the contents of the envelope and remove the same therefrom in a direction of withdrawal;

insert material within the envelope and removable therefrom through said end in said direction of withdrawal when said end is opened;

a view area designated by said front at which an aligned portion of said insert material may be viewed;

a series of at least two index marks on one of said insert and said front, each spaced from each other along a line generally parallel to said direction of withdrawal;

a series of first data receiving areas on said one of said insert and said front, one for each of said index mark, and located so as to be correlated with the associated index mark;

another index mark on the other of said insert material and said front and located generally on said line so as to be selectively alignable with each of said index marks in said series as said insert material is removed from said end in said direction of withdrawal; and a series of second data receiving areas on said insert material and spaced from each other along a line generally parallel to said direction of withdrawal and disposable in said viewing area, each said second data receiving area corresponding to one of said index marks in said series with adjacent ones of said second data receiving areas being spaced a distance corresponding to the spacing between the corresponding index marks in said series such that when said another index mark is aligned with any one of said index marks in said series, the corresponding second data receiving area will be disposed at said viewing area;

whereby data in a first data receiving area indexed by said another index mark and the corresponding index mark in said series can be mentally correlated with data in the corresponding second data receiving area appearing at said viewing area.

* * * * *